US010144225B2

(12) United States Patent
Koers et al.

(10) Patent No.: US 10,144,225 B2
(45) Date of Patent: Dec. 4, 2018

(54) DETECTION SEGMENT AS WELL AS DEVICE AND METHOD FOR PRINTING CONTAINERS

(71) Applicant: KHS GmbH, Dortmund (DE)

(72) Inventors: Sascha Koers, Bergkamen (DE); Michael Nick, Dortmund (DE); Katrin Preckel, Gelsenkirchen (DE)

(73) Assignee: KHS GmbH, Dortmund (DE)

( * ) Notice: Subject to any disclaimer, the term of this patent is extended or adjusted under 35 U.S.C. 154(b) by 0 days.

(21) Appl. No.: 15/543,079

(22) PCT Filed: Dec. 22, 2015

(86) PCT No.: PCT/EP2015/081001
§ 371 (c)(1),
(2) Date: Jul. 12, 2017

(87) PCT Pub. No.: WO2016/113090
PCT Pub. Date: Jul. 21, 2016

(65) Prior Publication Data

US 2018/0001624 A1 Jan. 4, 2018

(30) Foreign Application Priority Data

Jan. 12, 2015 (DE) ..... 10 2015 100 334

(51) Int. Cl.
*B41M 1/40* (2006.01)
*B41J 3/407* (2006.01)
*B41M 5/00* (2006.01)

(52) U.S. Cl.
CPC ..... *B41J 3/4073* (2013.01); *B41M 1/40* (2013.01); *B41M 5/0088* (2013.01)

(58) Field of Classification Search
CPC ..... B41J 3/4073; B41M 5/0088
See application file for complete search history.

(56) References Cited

U.S. PATENT DOCUMENTS 6,580,812 B1 * 6/2003 Harrington ..... G06T 13/80 348/156
9,259,952 B2 * 2/2016 Yamada ..... B41J 2/0057
9,815,637 B2 * 11/2017 Neubauer ..... B65G 47/244
9,821,569 B2 * 11/2017 Reiniger ..... B41J 3/4073
9,862,204 B2 * 1/2018 Izume ..... B41J 3/4073
(Continued)

FOREIGN PATENT DOCUMENTS

DE 199 27 668 12/2000
DE 10 2007 050 490 4/2009
(Continued)

*Primary Examiner* — Julian D Huffman
(74) *Attorney, Agent, or Firm* — Occhiuti & Rohlicek LLP

(57) ABSTRACT

A detection segment for use in a device for printing on containers includes an image-capturing device that optically detects a container feature and a sensor interface that interfaces with a sensor that uses a code provided on a retaining-and-centering unit that holds a container to determine a rotational position of that container. A computer connects to the image-capturing device and the sensor unit. The computer determines an alignment variable based on the code and the detected container feature and then forwards this alignment variable to a printer segment on a printer module.

21 Claims, 4 Drawing Sheets

(56) References Cited

U.S. PATENT DOCUMENTS

2011/0206496 A1* 8/2011 Hecktor ..... B65C 9/067 414/816
2012/0011807 A1* 1/2012 Preckel ..... B41J 3/4073 53/167
2012/0017783 A1* 1/2012 Uptergrove ..... B41J 3/4073 101/38.1
2012/0199021 A1* 8/2012 Till ..... B41J 3/4073 101/36
2013/0277909 A1* 10/2013 Ino ..... B65H 7/10 271/228
2014/0049585 A1* 2/2014 Tashiro ..... B41J 3/4073 347/102
2014/0368841 A1* 12/2014 Ojima ..... B41F 17/20 358/1.4
2014/0374016 A1* 12/2014 Schach ..... B41J 3/4073 156/277
2015/0059601 A1* 3/2015 Domeier ..... B41J 3/4073 101/40
2015/0113918 A1* 4/2015 Ehmer ..... B41J 3/4073 53/403
2016/0176212 A1* 6/2016 Silbert ..... B41J 2/32 347/19
2016/0200524 A1* 7/2016 Neubauer ..... B41J 3/4073 198/401
2016/0221708 A1* 8/2016 Ojima ..... B41M 5/0088
2016/0229198 A1* 8/2016 Izume ..... B41F 33/0045
2017/0157964 A1* 6/2017 Izume ..... B41F 33/0036
2017/0266982 A1* 9/2017 Schach ..... B65G 47/22

FOREIGN PATENT DOCUMENTS

DE 10 2011 112 106 2/2013
DE 20 2013 004 057 6/2013
DE 10 2013 208 061 7/2013
DE 10 2013 208065 7/2013
EP 1 769 916 4/2007
EP 2 251 270 11/2010
JP 3 041800 5/2000
WO WO2013/178418 12/2013

* cited by examiner

DETECTION SEGMENT AS WELL AS DEVICE AND METHOD FOR PRINTING CONTAINERS

RELATED APPLICATIONS

This is the national stage of international application PCT/EP2015/081001, filed on Dec. 22, 2015, which claims the benefit of the Jan. 12, 2015 priority date of German application DE102015100334.1, the contents of which are herein incorporated by reference.

FIELD OF INVENTION

The invention relates to container handling, and in particular, to printing on containers.

BACKGROUND

It is known to use inkjet printers to print upon containers. Such printing takes place on rotary printing machines in which inkjet printers are placed on the circumference of a rotor.

A problem with known printing devices is that of precisely-placing printed matter relative to container feature, such as an embossing, a seam, a container decoration, or a compensation region for the hot filling (referred to as a hot-fill panel) could take place. This results in an aesthetically unpleasing appearance to the printed container.

SUMMARY

An object of the invention is to provide a detection segment that facilitates printing upon a precise location on the container in relation to the container's rotation position even when a great many containers are being printed per unit time.

According to a first aspect, the invention relates to a detection segment. The detection segment is provided for use in a device for the printing of containers. The detection segment includes at least one image-capturing device for detecting an optical feature of a container. This image-capturing device is preferably a camera, in particular a line camera, by means of which image information of a container that is to be printed upon can be acquired before it is printed in order to detect a predefined container feature.

The detection segment further includes a retaining-and-centering unit for retaining a container, or means for retaining and releasing retaining-and-centering units. The container held at a retaining-and-centering unit can be rotationally driven about its container vertical axis in order to be able to move the container relative to the image-capturing device. The retaining-and-centering unit or the means for retaining and releasing retaining-and-centering units are mechanically connected, by way of a housing or another carrying structure of the detection segment, to the image-capturing device such that no, or only negligible, relative movements occur between the image-capturing device and the retaining-and-centering unit that secures the container.

The detection segment further includes a sensor unit or interface for coupling to a sensor unit. The sensor unit can be a constituent part of the detection segment, or can be provided, such as to be detachable, at the retaining-and-centering unit, which in turn can be connected to the detection segment. The sensor unit is designed to determine the rotational position of a container retained on a retaining-and-centering unit by detecting a code provided on the retaining-and-centering unit. The code can, in particular, be a constituent part of an absolute encoder, by means of which the angular position can be detected of a part of the retaining-and-centering unit, rotating with the container, referred to hereinafter as the secondary part.

Also provided in the detection segment is a computer that is connected, at least from time-to-time, to the image-capturing device and the sensor unit for the exchange of information therebetween. The computer is designed to determine an alignment variable based on the code provided on the retaining-and-centering unit and the detected optical feature of the container. In addition, the detection segment includes communication means for passing on the alignment variable to the container retaining device.

An advantage of a detection segment having the foregoing features is that containers can be printed while being aligned to known container features in a downstream printing device. This promotes optically attractive container printing.

In one embodiment, the detection segment is provided at a rotor that rotates about a vertical machine-axis. Accordingly, the container is moved together with the image-capturing device through the rotor. This has the advantage that, during the further movement of the container along the transport path, image information of the container is detected by an image-capturing device that rotates with it. This allows distortion-free image information to be obtained, i.e. information that is not influenced by relative movement between the image-capturing device and the container.

In one embodiment, the detection segment is a detection module that is replaceable in its entirety. The detection segment includes a housing or other carrying structure, such as a frame, in or at which all those components that are necessary for the detection segment's operation are arranged. These include the image-capturing device itself, the computer, the communication means or communication interfaces, and the retaining-and-centering unit. Additional components that can be carried include a lighting unit for lighting up the region that is to be inspected and a memory unit or storage for storing information for use in identifying container features.

The detection module is preferably equipped with a rapid-replacement mechanism such that the detection module can be replaced without or essentially without the use of tools.

Additionally provided in the detection module or the housing or the carrying structure of the detection module is a first part of an electrical plug connection that interacts with a second part of an electrical plug connection provided at a rotor in such a way that, when the detection module is brought to the rotor, i.e. without further mechanical work, an electrical connection or a data connection can be established between the detection module and the other components of the container treatment device.

Due to the modular design of the detection segment, substantial advantages can be achieved with regard to the maintainability of individual detection segments since they can be individually replaced and maintained. In addition, due to the simple procedure for replacing individual detection modules, a defect in a detection module results incurs only a short machine down time.

In some embodiments, the computer determines an angle difference between a reference mark and an optically-detected container feature. This detected angle difference, or an alignment variable derived from this, is forwarded by a communication interface to at least one printing segment.

In some embodiments, the reference mark is one that is determined independently of the container's rotational position or of that of the rotatable secondary part of the retaining- and -centering unit in relation to which the rotational position or rotational setting of a container feature, which is to be taken into account during the printing, is indicated by an angle difference. For example, the printing of the container usually takes place beginning with or in relation to the reference mark. By determining the angle difference, it is possible to print instead in relation to a container feature zero mark that is displaced from the reference mark by the angle difference.

In one embodiment, a rotary drive drives the container in a controlled manner based on the code. Among these embodiments are those in which a motor drive rotationally drives a secondary part that is both mounted such as to be rotatable in the retaining-and-centering unit and also connected to the container. Among these are embodiments in which the motor drive is a direct drive. By controlling of the rotary drive based on the code, it is possible to rotate the container exactly in accordance with the alignment variable. This permits printing in an image that is aligned to a container feature.

In one embodiment, the image-capturing device detects image data concerning only part of the container's circumference, whereas in others, it detects image data concerning the entirety of the container's circumference. In either case, the image-capturing device is able to do so because the container rotates relative to it.

In some cases, there is no information available concerning where the container feature to be used for the alignment is located. Under these circumstances, the image-capturing device captures image data over a full 360° rotation of the container.

Alternative embodiments carry out a preliminary alignment of the container so that at least some information is available. This reduces the extent of the circumference that the image-capturing device must search.

In these embodiments, preliminary alignment of the container takes place while the container is still on the transport path upstream of the detection segment. Typically, there is at least one further recognition device to estimate the container feature's location. Based on the findings of this recognition device, the container is rotated to bring the container feature to lie at a particular desired location or at a defined angular range. This saves time in recognizing the container feature.

In some embodiments, the detection segment includes data storage for storing information concerning the container feature. This allows data concerning the container feature to be stored once into the storage and used over and over again without having to access a central computer or machine network to obtain it. This reduces load on the machine network and improves performance.

In some embodiments, a computer evaluates the image data acquired by the image-capturing device and compares it to stored data that relates to the container feature that is being sought by the image-capturing device. After having detected this container feature, the computer compares the data stored in the memory unit and the image data acquired by the image-capturing device. This comparison makes possible subsequent printing of the container on the basis of a predetermined container feature that is to be identified by the computer based on acquired image data.

In some embodiments, the computer uses a block-matching process in the evaluation of the image data and/or in the comparison of the image data with the stored data. Examples of such comparison include comparison between gray value distributions between two blocks of equal size, and in particular, between pixel matrices. By the use of the block-matching process, the identification of a specific feature within the image information provided by the image-capturing device can be carried out more rapidly.

In some embodiments, the computer carries out parallel processing of the image data. Such embodiments typically feature the use of graphics-card programming to execute necessary computations in parallel across several graphics processing units. Such graphics processing units are referred to in short as GPGPUs (General Purpose Computation on Graphics Processing Units). With such parallel algorithms, an enormous increase in speed can be achieved in comparison with the main processor. This allows in particular for an increase in the processing speed.

In some embodiments, the communication with the downstream container printing device is wireless whereas in others it is wire-bound. Suitable mechanisms for communication include the use of radio, WLAN, Bluetooth, and infrared links or other optical interface. Alternatively, communication can rely on a cable-bound transfer interface to a directed near-field communication means. A preferred communication mechanism relies on an infra-red interface that sends directionally-transmitted optical signals in the infra-red range.

In some embodiments, the detection segment is configured for onward conveying of a retaining-and-centering device, aligned in relation to the rotational position of the container to a downstream container-printing segment. The detection segment rotates the container transferring it to a printing segment and does so in a way that places the container region at which printing should begin opposite or at least almost opposite the print head provided at the first printing segment. This reduces or substantially eliminates time required for the printer to rotate the container into the correct position, thereby improving overall processing speed.

According to a second aspect, the invention relates to a device for the printing upon containers with a conveyor transport segment on which the containers are moved in a transport direction from a container inlet to a container outlet. A set of rotors forms the container transport segment. Each rotor rotates about a vertical machine-axis. Each rotor retains, centers, and/or moves containers in a controlled manner. At least one rotor defines a detection module having a plurality of detection segments or stations for detecting container features. At least one rotor following the detection module in the transport direction includes a plurality of printing stations or printing segments for printing on the containers.

Each detection segment includes an image-capturing device for optically detecting a container feature, a retaining-and-centering unit for retaining a container or a means for holding and then releasing a retaining-and-centering unit, wherein a container retained at a retaining-and-centering unit can be rotationally driven about its container vertical axis, a sensor unit, or an interface to a sensor unit, to determine the rotational position of a container retained at the retaining-and-centering unit by detecting a code provided on the retaining-and-centering unit, and a computer connected to the image-capturing device and to the sensor unit. The computer is configured for calculating an alignment variable based on the code provided on the retaining-and-centering unit and on the container feature. The detection includes a communication interface for forwarding the alignment variable to at least one downstream printing station.

An advantage of the printing device arises because containers can be printed aligned on recognized container features in a printing station following the detection station. This results in more aesthetically pleasing images on a container.

According to one embodiment, between the first and second rotor a transfer of retaining-and-centering units with containers retained in them takes place. Accordingly, between the detection station and the printing station, a unit consisting of a container and a retaining-and-centering unit is transferred, wherein this unit, the rotational position of the container relative to the rotating part of the retaining-and-centering unit, referred to herein as the "secondary part," is retained during and after the transfer. Accordingly, a code provided at the retaining-and-centering unit, in particular at the secondary part, can be used in the printing station for determining the container's rotational position.

According to one embodiment, the device is configured for detecting an alignment variable for every container retained at a retaining-and-centering unit and for the specific forwarding of the alignment variable to a downstream printing station that then prints upon the container. Accordingly, of a plurality of printing stations provided at a rotor, the only printing station that receives and uses the alignment information associated with a container is that printing station that will actually print on that container. The alignment variable is thus only forwarded selectively to the printing station that requires this alignment variable for the alignment of the container for it to be printed.

Other embodiments have plural printing modules, each of which prints a particular color on a container. Each printing module has printing stations thereon. In such embodiments, a device for determining an alignment variable for a particular container is configured for every container retained on a retaining-and-centering unit and for specific forwarding of the alignment variable only to those printing stations at which printing on the particular container will be carried out. Accordingly, the alignment variable is only forwarded to those printing stations that will require this alignment variable for the alignment of the container for it to be printed.

According to one embodiment, the forwarding of the alignment variable between the detection segment and the downstream printing station takes place successively by near-field communication, for example using an infra-red interface. In particular, the alignment variable is transferred from the detection segment to the printing station concurrently with transfer the container retained at the retaining-and-centering unit. At this instant, the detection segment and the printing station are located opposite one another in such a way that a transfer can take place using near-field communication via the infra-red interface.

According to a third aspect, the invention relates to a method for printing on containers. Such a method includes optically detecting a container feature using an image-capturing device; determining a rotational position of a container retained at a retaining-and-centering unit based on a code provided at the retaining-and-centering unit; determining an alignment variable, based on the code and the container feature, and forwarding the determined alignment variable to at least one printing device; and printing upon the container based on the alignment variable.

As used herein, "containers" means bottles and cans.

As used herein, "essentially" or "approximately" mean deviations from an exact value that are insignificant to regard to function.

Further embodiments, advantages, and possible applications of the invention are also derived from the following description of embodiments and from the figures. In this context, all the features described and/or graphically represented are in principle the object of the invention, taken individually or in any desired combination, regardless of their inclusion in the claims or reference to them. The contents of the claims are also made a constituent part of the description.

BRIEF DESCRIPTION OF THE DRAWINGS

These and other features of the invention will be apparent from the following detailed description and the accompanying figures, in which.

DETAILED DESCRIPTION

Figure 1:
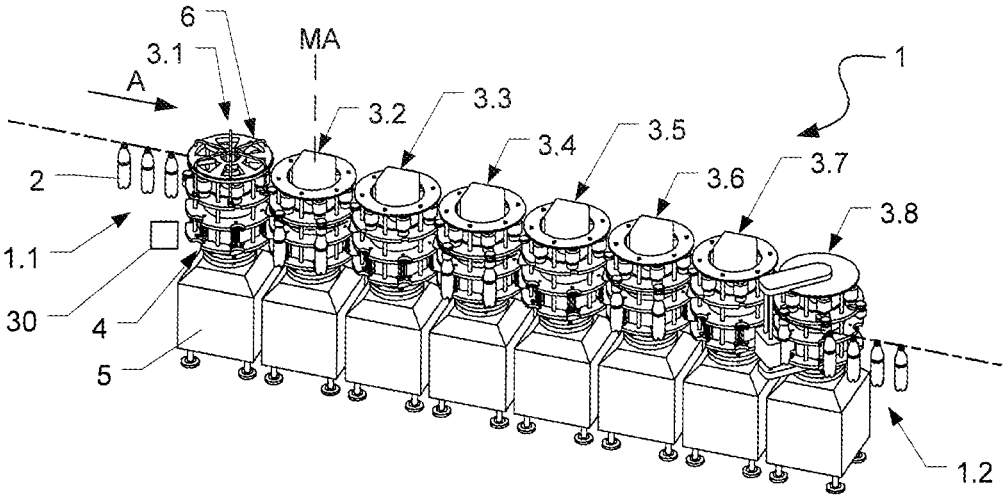
FIG. 1 shows a perspective view of a printing device having modules in series.

FIG. 1 shows a printing device 1 that prints upon containers. The containers are typically bottles. The resulting printed images are applied either directly onto the container's wall or onto a label that has already been applied onto the container's wall.

Figure 2A:
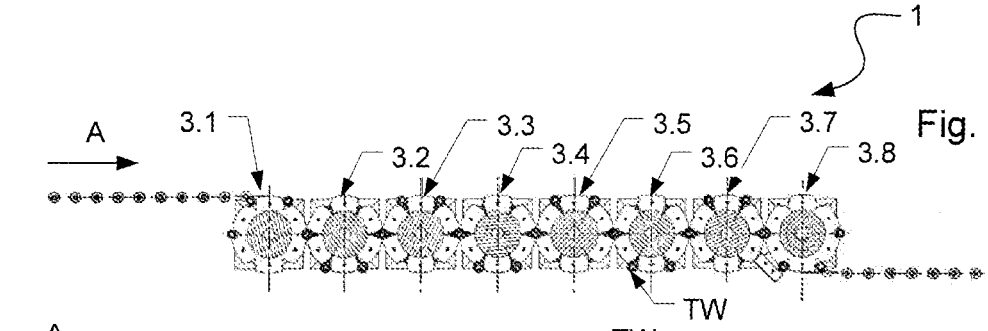
FIG. 2 shows a top view of the printing device shown in FIG. 1.

An outside transporter brings containers to be printed upon to a container inlet 1.1 of the printing device 1. These containers 2, which stand upright, move through the printing device 1 on a serpentine transport path TW. After having been printed upon, the transport path TW brings the containers, still standing upright, to a container outlet 1.2 from which an outside transporter takes them for further use. The transport path TW can be seen in FIG. 2*a* and schematically in FIG. 2*b*.

The printing device 1 includes a plurality of modules 3.1-3.*n* that are connected directly to one another in the transport direction A. In the illustrated embodiment, there are eight such modules 3.1-3.8. The same basic unit 4 forms the basis of each module 3.1-3.8. To make a particular module, one begins with the basic unit 4 and adds the functional elements necessary for the special task of that module 3.1-3.8.

Each basic unit 4 includes a rotor 6 and a drive-and-control unit that rotates the rotor 6 about a vertical machine axis MA. The drive-and-control unit is located in a module housing 5 and the rotor 6 is arranged on an upper side of the module housing 5.

The rotor 6 carries treatment segments 7 on a periphery thereof. A typical treatment segment 7 can be seen with its companion treatment segments in FIG. 3 and by itself in FIG. 4. The nature of these treatment segments 7 is what gives the module 3.*n* its function. For example, if a treatment segment 7 has a print head, then the module will be a "printing module." Such a treatment segment 7 will be referred to herein as a "printing segment."

Figure 3:
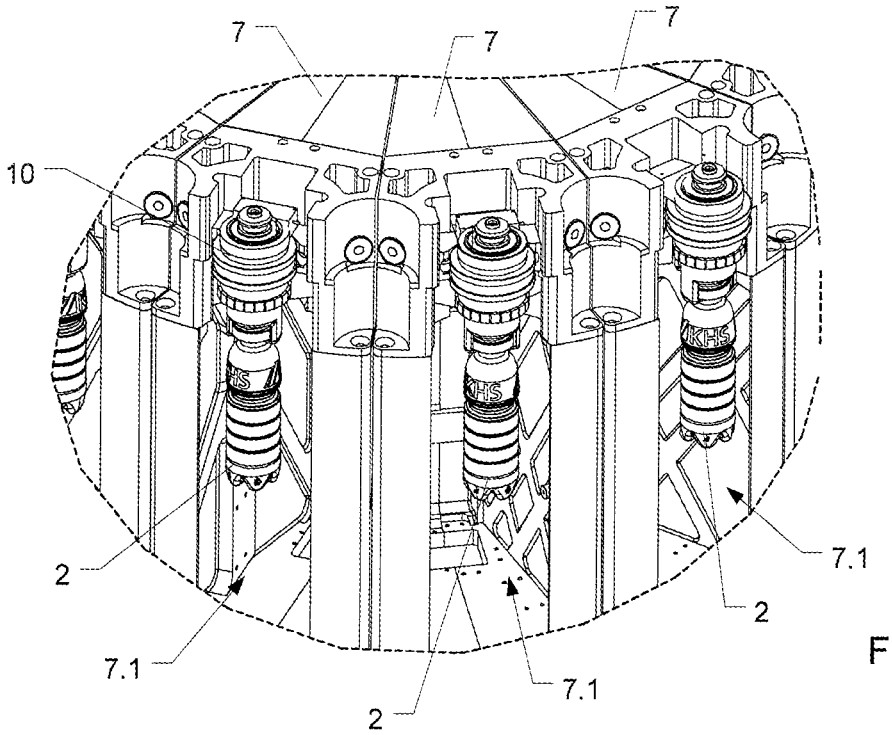
FIG. 3 shows a top view of a serpentine transport path through the modules shown in FIG. 1.
Figure 4:
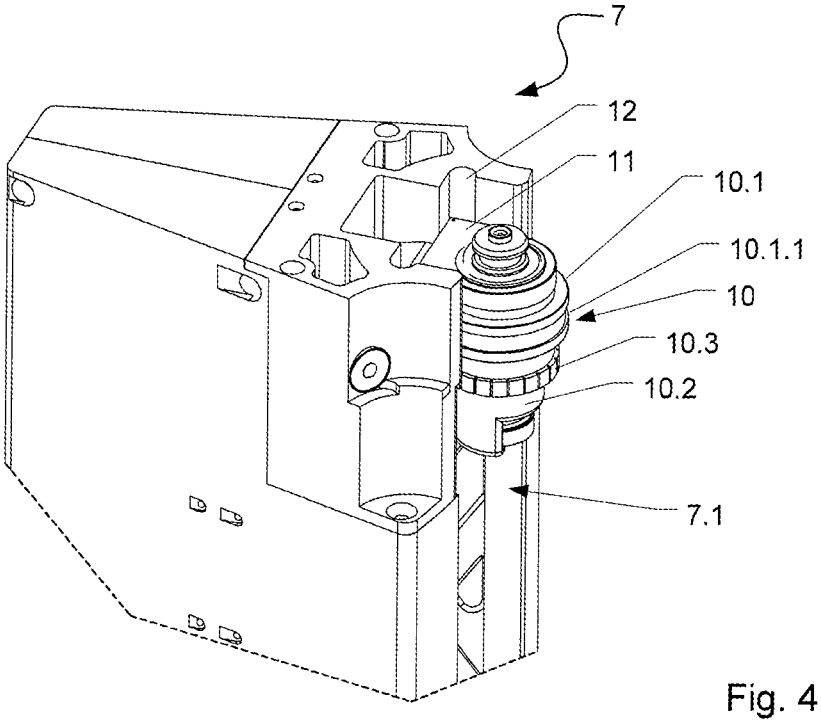
FIG. 4 shows a perspective view of a treatment segment from one of the modules shown in FIG. 1 while holding a retaining-and-centering device.

Referring to FIGS. 3 and 4, each treatment segment 7 has something that holds onto a container. In some cases, this would be a retaining-and-centering unit 10 allocated to the treatment segment. This retaining-and-centering unit 10 retains and centers the container 2 that is to be printed upon as it passes through the printing device 1. In other cases, the treatment segment 7 has a holder that selectively holds and then releases a retaining-and-centering unit 10. An example would be a mounting that is located at the treatment segment 7 and in which the retaining-and-centering unit 10 can be secured to the treatment segment 7 during treatment and then detached from the treatment segment 7 after treatment. During the rotation of a rotor 6, the retaining-and-centering unit 10 holds the container 2 that is to be treated opposite the treatment segment 7. Being thus held, the container 2 is transported further along the transport direction A simultaneously with its treatment.

Referring back to FIG. 2*a*, which is a top-view of the printing device 1 shown in FIG. 1, the rotors 6 of adjacent modules 3.*n*–3.(n+1) are directly connected to each other such that a container that leaves one module 3.*n* immediately enters the next module 3.(n+1) in the series of modules.

The printing device 1 begins with an inlet module 3.1 that carries out container pre-treatment. Examples of such pre-treatment include plasma or corona treatment. This pre-treatment is particularly useful when subsequent printing modules carry out ink-jet printing.

A detection module 3.2, which is immediately downstream from the inlet module 3.1, includes detection segments arranged on a circumference thereof. An exemplary detection segment 20 can be seen in FIG. 5. Referring to FIG. 6, a detection segment 20 detects one or more container features BM that are used in subsequent printing steps. In the illustrated embodiment, the container feature BM is a boss.

Four printing modules 3.3-3.6 follow the detection module 3.2. Each printing module 3.3-3.6 prints a different color. In particular, the four printing modules 3.3-3.6 print yellow, magenta, cyan, and black.

A drying module 3.7 follows the printing modules 3.3-3.6. The drying module 3.7 applies energy, such as heat or UV radiation, to cure or dry the ink applied by the printing modules 3.3-3.6.

The outlet module 3.8 forms the container outlet 1.2 through which the finished printed-containers leave the printing device 1. In some embodiments, the outlet module 3.8 is also a drying module.

The arrangement of modules 3.1-3.8 as described herein is only one of many possible arrangements. Indeed, the whole point of such modular design is to permit unlimited flexibility. Thus, further modules, such as an inspection module, can be added, and other modules can be omitted.

The rotors 6 of adjacent modules 3.*n*, 3.(n+1) rotate in alternating directions but in synchrony. As a result, the rotors 6 cooperate to define the serpentine path TW shown in FIG. 2*b*.

Figure 2B:
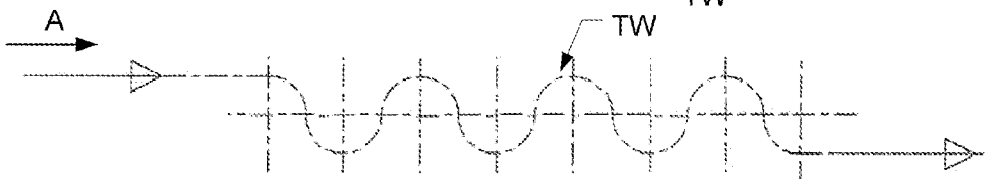

As shown in FIG. 2*b*, the inlet module 3.1 and the outlet module 3.8 move containers along ninety degrees of a circular path. The remaining modules 3.2-3.7 move the container 2 an angular range of 180°. As the container 2 traverses this angular range, the particular module 3.2-3.7 carries out its processing task.

FIG. 3 shows a plurality of treatment segments 7 mounted around a periphery of a module 3.2-3.8. These treatment segments 7 can be swapped in and out as a unit. Each treatment segment 7 contains all functional elements needed to carry out its function. To fit conveniently on the rotor 6, the treatment segments 7 are shaped like segments of an annulus so that they fit together to form a ring around the periphery of the rotor 6. The rotor 6 rotates the treatment segments 7 about the module's vertical axis MA either continuously or intermittently.

Each treatment segment 7 has a cut-out aperture 7.1 on a peripherally outer surface thereof so that the aperture 7.1 faces away from the machine axis MA. It is in this aperture 7.1 that a container 2 will be held during treatment thereof. Typically, the container will be suspended from its mouth or upper region and hang down the aperture 7.1 with its container axis parallel to the machine axis MA.

As shown in FIG. 4, a carrier 11 holds the retaining-and-centering unit 10. The carrier 11 is itself held in lateral grooves 12. Optionally, a drive moves the carrier 11 so that it slides along the grooves 12. This permits adjustment for different container formats. The retaining-and-centering unit 10 retains and centers a container 2 and rotates or pivots the container during treatment thereof. It includes a primary part 10.1 and a secondary part 10.2.

The primary part 10.1 is held at the carrier 11. It secures the retaining-and-centering unit 10 to the treatment segment 7, and in particular, to its carrier 11 or to its mounting. To carry out this purpose, the primary part 10.1 includes a reference surface 10.1.1 for which a complementary counter-piece in the treatment segment 7 serves as a reference plane or surface for contact mounting and therefore for adjustment relative to the function elements provided at the treatment segment 7. Examples of such functional elements include a camera, a print head, and a hardening device. This results in a secure common connection between the retaining-and-centering unit 10, the container 2, and the function elements.

In the treatment segment 7, the force that holds the primary part 10.1 is passive. To release the primary part 10.1 thus requires an active release. This promotes safety in the event of a power failure or loss of media supply. A suitable source of a passively applied force is a permanent magnet.

The secondary part 10.2 suspends the container 2. To do so, the secondary part 10.2 forms a gripper. Examples of grippers include mechanically-actuated grippers, pneumatically-actuated grippers, and vacuum grippers.

The secondary part 10.2 includes all the components needed for aligning, rotating, and pivoting containers during treatment. These would include such elements as those required for alignment and/or rotation during printing, and/or the elements for providing compressed air and/or vacuum to operate the grippers.

Accordingly, in the embodiment represented, the secondary part 10.2 is mounted on the primary part 10.1 such as to be rotatable or pivotable about the printing segment axis DA. It also forms the rotor of an electrical actuator or angle drive for the alignment and controlled rotation or pivoting of the containers 2 during treatment thereof.

To function as a rotor, the secondary part 10.2 includes a permanent-magnet arrangement 10.3 that includes a plurality of permanent magnets. The permanent-magnet arrangement 10.3 includes magnetic north and south poles alternating in a circumferential direction. These interact with an electromagnet arrangement provided at the carrier 11. Accordingly, the carrier 11 forms the stator of the actuator or the electromagnetic direct-drive respectively.

A code at the primary part 10.1 interacts with an incremental sensor at the treatment segment 7 to form an encoder system that detects the orientation of the primary part 10.1, and therefore that of the retaining-and-centering unit 10 itself. This permits controlled alignment and/or rotation of a container 2 in a manner that takes into account the orientation of the primary part 10.1 relative to the rotary position of the secondary part 10.2, and specifically, the rotation of the secondary part 10.2 with the primary part 10.1 remaining stationary.

In particular, an encoder system arranged at the secondary part 10.2 permits determination of the secondary part's rotational position and that of a container 2 present at the secondary part.

Embodiments of the secondary part's encoder system include absolute and relative encoder systems. An absolute encoder system encodes an absolute rotational position of the secondary part 10.2 and of the container 2 respectively. A relative encoder system encodes position relative to some other part. The alignment and controlled rotation of a container 2 about the container's vertical axis takes place in relation to the treatment segment 7 or in relation to function elements that carry out the treatment.

Figure 5:
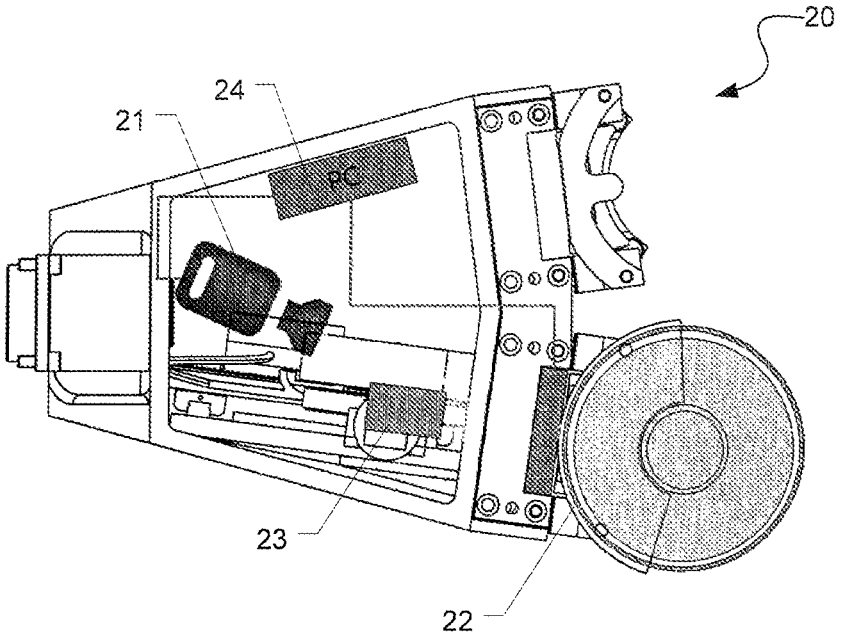
FIG. 5 shows a detection segment, with its upper housing removed, from the detection module shown in FIG. 1 for detecting a container feature and providing an alignment variable for subsequent printing devices.
Figure 6:
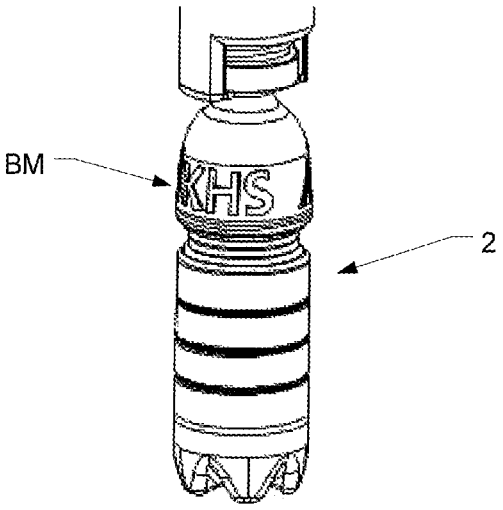
FIG. 6 shows a container having a boss as a container feature, and by way of example, a container with a relief-type container feature (embossing)

FIG. 5 shows a detection segment 20 from the detection module 3.2.

The detection segment 20 includes a housing or at least a carrying structure in which are arranged all the function elements necessary for the function of the detection segment 20. In particular, the detection segment 20 includes at least one image-capturing device 21 that captures an image of the container to be treated. Embodiments of the detection segment 20 include those in which the image-capturing device 21 is a digital camera, in particular a digital line-camera as well as those in which it is a 3D camera.

The detection segment 20 further includes an accommodation mounting 22 for a retaining-and-centering unit 10 that is similar to that described heretofore in connection with FIGS. 3 and 4. The accommodation mounting 22 permits the retaining-and-centering unit 10 to hold a container 2 and to rotate it about its vertical axis. This, in turn, permits a container feature BM provided at the container wall on the circumferential side to be detected. Such a container feature BM can include container seams, previously applied container decorations, bosses, relief-like structures on the container wall, hot-fill panels, or expansion regions for accommodating expansion that occurs when filling with hot filling-material.

The detection segment 20 includes some mechanism to accommodate containers of different sizes and shapes. In some embodiments, the accommodation mounting 22 is height-adjustable. In others, it is configured so as to extend in a vertical direction.

Another way to accommodate different formats is to have the image-capturing device 21 be movable within the detection segment 20. This permits the distance to the container 2 to be varied.

Yet another way to accommodate different formats is to provide the image-capturing device 21 with adjustable focusing. This permits focusing on the container 2 even if the distance to the container 2 changes.

Another useful component within the detection segment 20 is a lighting device 23. Such a lighting device 23 permits illumination of a container region that faces either the detection segment 20 or the image-capturing device 21.

The detection segment 20 can also include a computer 24 coupled to the image-capturing device 21 for processing of image data provided by the image-capturing device 21. As a result, the image data acquired by the image-capturing device 21 can be further processed in modular fashion, i.e. separately for each detection segment 20. This, in turn, spreads the processing load so that even at high container-processing speeds, it is possible to process image data at close to real time without the need to incur delays from transfer via a network.

The computer 24 computes an alignment variable. An alignment variable can be angle data, an angle difference, or other data that allows alignment of the container into a desired rotational position, such as coding information used in connection with the coding provided at the retaining-and-centering unit 10. This alignment variable makes it possible to align the container 2 relative to a recognized container feature BM. This, in turn, permits printing at a location relative to the container feature BM.

Within the detection segment 20, the image-capturing device 21 detects alignment information from the container's side wall as the secondary part 10.2 rotates or pivots the container 2.

A communication unit within the detection segment 20 passes the alignment information to modules downstream of the detection module 3.2, and in particular, to the printing modules 3.3-3.6.

The image data detected by the image-capturing device 21 is transferred to the computer 24. The computer 24 compares the image data with sample image-data that has been previously stored in storage. In some embodiments, the storage is central storage that is used by all of the detection segments 20 in the detection module 3.2. In others, storage is decentralized, in which case the sample image-data is stored in local storage of each detection segment 20.

One of many suitable process that the computer 24 can use to compare image information provided by the image-capturing device 21 with the sample image-data is a block-matching process. Execution of this process includes rotating the container 2, having the image-capturing device 21 collecting blocks of image data during the rotation, and having the computer 24 identify, from those collected blocks, that block of image information that corresponds most closely to the sample image-data. To carry out the identification process at the speeds required to achieve close to real-time processing of image data, it is useful for the computer 24 to carry out parallel processing using graphics card programming.

FIG. 6 shows a container in which the container feature BM is a boss that forms the letters "KHS." In this exemplary embodiment, the image data that corresponds to this container feature BM would be stored as the sample image-data. As the bottle rotates, the computer 24 would look for partial image-data within the image data provided by the image-capturing device 21. The partial image-data sought would be that which corresponds most closely to the sample image-data. This amounts to recognizing the container feature BM.

In addition to the image data, the computer 24 records data indicative of a rotational angle of the container at the time the image data was recorded. As a result, having identified the partial image-data that corresponds most closely to the sample image-data, the computer 24 is able to identify the rotation angle of the container 2 at the time that corresponds to the location of the container feature BM.

In order to be able to identify the rotation angle more precisely, it is useful to identify the beginning, middle, and end of the container feature BM. This can be carried out using the code provided at the secondary part 10.2. In the case in which the code is part of an absolute encoder system, these three rotation angles can be identified. In the case in which the code is part of a relative encoder system, these angles are identified with reference to a container feature that defines a zero mark on the container. The location of this zero mark is container-specific and therefore valid only when that type of container is being processed.

The detection module 3.2 passes an alignment variable to the printing modules 3.3-3.6 downstream from it. This alignment variable is derived from the detected rotation angle. In one embodiment, shown in FIG. 7, the coding provided at the secondary part 10.2 includes a reference mark. In this embodiment, the alignment variable is an angle difference between the reference mark and the container feature's zero mark.

When carrying out the printing itself, the downstream printing modules 3.3-3.7 take into account the rotation angle offset that corresponds to the alignment variable. As a result, container printing does not begin at the reference mark. Instead, it begins at the container feature's zero mark.

Figure 7:
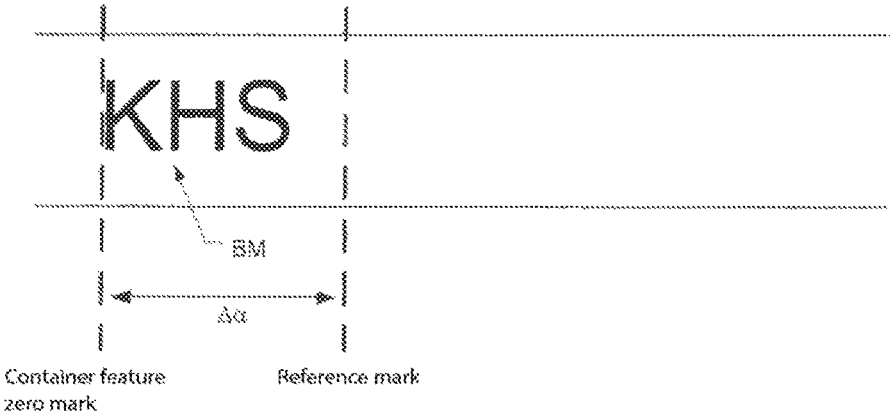
FIG. 7 shows the location of a container-feature's zero mark in relation to a reference mark of the retaining and centering device.

As shown in FIG. 7, the encoder system's reference mark lies at any desired point of the container 2. In contrast, the container feature's zero mark has been set to mark the beginning of the boss "KHS." An angle difference, $\Delta\alpha$, between the reference mark and the container feature's zero mark, or a value derived from that angle difference, is passed on as the alignment variable to the downstream printing modules 3.3-3.7 so that container printing begins with the printing heads aligned with the container feature's zero mark and not the reference mark.

A particular detection segment 20 on the detection module 3.2 will hand over its container 2 to a particular one of the printing segments in the first printing module 3.3. After having printed its color onto the container, this printing segment will then hand over the same container to a particular one of the printing segments in the second printing module 3.4. This proceeds until the last printing module 3.6.

In general, the alignment variable identified by a particular detection segment 20 will not be the same as those identified by other detection segments. It is thus important that when a particular detection segment 20 determines the alignment variable, that alignment variable is only propagated to the specific printing segments that will be printing upon that particular container.

A simple way to implement this is for a print segment in the $n^{th}$ module 3.*n* to forward the alignment variable that it receives from the $(n-1)^{the}$ module only to the appropriate print segment in the $(n+1)^{th}$ printing module 3.(n+1), where n ranges from 3 to 5 inclusive in the printing device 1 shown in FIG. 1.

A preferable way to carry out the foregoing forwarding of the alignment variable is through directed transfer from a segment on the $n^{th}$ module to a corresponding segment on the $(n+1)^{th}$ module, with the directed transfer occurring concurrently with transfer of the container 2 from the $n^{th}$ module to the $(n+1)^{th}$ module at the moment during which segment holding the container 2 at the $n^{th}$ module faces the segment that is to receive the container 2 at the $(n+1)^{th}$ module.

In some embodiments, the segment holding the container 2 at the $n^{th}$ module has an infrared transmitter and the segment that is to receive the container 2 at the $(n+1)^{th}$ module has an infrared receiver that faces the infrared transmitter when container transfer takes place. This makes it simple to transfer data via an infrared communication link at the moment that the transfer of the container 2 from the $n^{th}$ module to the $(n+1)^{th}$ module takes place. It is also possible to use other data transfer mechanisms in the same way. These would include RFID, Bluetooth, WLAN, and the like.

A machine network interconnects the various modules 3.1-3.*n*. An advantage of the direct transfer of the alignment variable between two segments is that doing so avoids burdening this machine network. Additionally, doing so avoids delays inherent in the use of the machine network. This is particularly important for the time-critical transfer of the alignment variable between moving segments. Avoiding the use of the machine network thus permits more rapid container-processing.

A significant source of poor image-quality is misalignment of the images corresponding to the four colors used in conventional printing. The use of an alignment variable by all printing modules 3.3-3.6 promotes a high-quality multi-colored printed image by promoting the correct alignment of the four print heads on a container-by-container basis.

At high processing-speeds, the precision required imposes considerable demands on the precision and speed of the hardware and software in the receiving and processing of image data, the determination of the alignment variable or alignment information, and the forwarding of this alignment variable or alignment information to subsequent segments.

For example, a container feature is required to be detected on the circumferential side, with adequate resolution, in a time period of less than one second (e.g. precision of image point or pixel approx. 10 μm) by the image-capturing device 21, container features detected by a comparison with sample image information, an alignment variable or alignment information detected and passed on to treatment segments 7 following in the transport direction A, and the container then aligned on the basis of the alignment variable or alignment information. In order for the necessary precision to be achieved with, at the same time, a high processing-speed, a number of mechanisms and devices can be provided which increase the processing speed:

One way to speed up the alignment of the container 2 on the basis of the alignment variable is to have the detection segment 20 carry out preliminary alignment on behalf of the printing segment that is to follow. As a result, after the transfer of the retaining-and-centering unit 10 from the detection segment 20 to the printing station, the container 2 will already have adopted almost the correct orientation required for printing to begin. This means that the printing segment will only have to make a slight rotation of the container 2 about its vertical axis. Since a small angle-adjustment can be made far more quickly than a large angle-adjustment, this enables printing to begin almost immediately.

To increase the processing speed still further, it is preferable to us an absolute encoder system at the retaining- and centering unit 10. An absolute encoder system determines the absolute rotational position directly. Preferably, based on the alignment variable and the known starting position, it is possible to choose the shortest path to arrive at the reference rotation-position.

To further promote error-free operation at high processing speeds, it is useful to carry out a preliminary alignment of the container 2 on the transport path TW before even transferring it to the detection module 3.2. The preliminary alignment of the container 2 can be effected in such a way that the detection module 20 receives the container with its container feature BM in a position facing its image-capturing device 21. As a result, the container 2 only needs to be rotated further by a limited angle range that is less than 180 degrees.

One might well wonder how this is to be done. After all, if the detection module 3.2 is what detects the container feature BM, nothing upstream of the detection module 3.2 could possibly take any action that depends on the location of the container feature BM.

This difficulty can be remedied, as shown in FIG. 1, by providing an one or more optical detection-devices 30 upstream of the first module 3.1 at one or more corresponding fixed positions on the transport path TW. The use of two or more optical detection-devices 30 is advantageous since the container 2 can then be observed from more than two or more angles. Although these optical detection-devices 30 cannot achieve the level of precision provided by the detection module 3.2, they are sufficient to coarsely locate the container feature BM. A suitable optical detection-device 30 would be a camera.

After the optical detection-device 30 provides a rough estimate of the container feature's rotational position, the container is made to pivot about its vertical axis to an extent needed to ensure that when it arrives at the detection segment 20, the container feature BM more or less faces the detection segment's image-capturing device 21. As a result, the detection segment 20 will only have to further rotate the container by a limited amount, for example less than 180 degrees, to identify the container feature BM.

The detection segment 20 is not limited to rotating the container in preparation for printing. It can also be used to carry out quality assurance of the container 2.

In such embodiments, the computer 24 analyzes the image acquired by the image-capturing device 21 to identify optical peculiarities. In one inspection procedure, the computer 24 identifies rotational asymmetries while the container 2 rotates relative to the image-capturing device 21. This can be carried out by comparing data received from the image-capturing device 21 with reference data to evaluate the container's rotational symmetry. In order to evaluate rotational symmetry, it is useful to avoid considering container features such as bosses and hot-fill panels since these would not be pertinent to evaluating rotational symmetry.

If a container's rotational symmetry is inadequate for printing, a number of actions can be taken. One is to not print on that container 2 at all. Another is to print only in a rotationally-symmetric region of that container 2.

A base-detection device provides another way to evaluate rotational symmetry. Such a base-detection device can be provided in the region of the detection module 3.2 or in the transport direction A upstream of the detection module 3.2. This base-detection device detects the container's base by inspecting the container's underside in the region of its standing surface.

The base-detection device can be moved with the module's rotor 6 or be stationary. Some embodiments have two or more base-detection devices distributed along the transport path TW in the region of the inlet module 3.1 and/or the detection module 3.2. These base-detection devices detect the injection point of a container 2 as it moves past. The injection point is a central elevation on the underside of the container 2.

The existence of two different images of the base at different rotation angles permits the centering of the injection point to be analyzed. To the extent that the injection point is eccentric, one can infer that the container 2 may be rotationally asymmetric. This provides a basis for determining whether the container 2 is fit to be printed upon.

If the container 2 is deemed to be unsuitable for being printed upon as a result of having an eccentric injection point, the container 2 is not printed upon and later screened out.

Yet another way to evaluate a container's rotational symmetry is to use either a 3D camera or a 3D laser scanner to gather data indicative of the container's outer contour. Such data can then be analyzed to determine whether an extent of rotational asymmetry exceeds some threshold value. If it does, the container 2 is not printed upon and later screened out.

Data acquired by the image-capturing device 21, or further detection devices can also be used to control the subsequent printing process of the containers 2 in an appropriate manner.

For example, in a printing segment that has an inkjet print head with nozzles, the emission of ink from the nozzles can be controlled in such a way that the container's contour is printed upon in an optimum manner. Such control extends to controlling how much ink to emit and the velocity vector of the ink as it is jetted out through the nozzle. In particular, the direction of the velocity vector, which corresponds to the ink's emission direction, can be controlled by imposing an electric field at the nozzle to deflect the ink jet by an appropriate amount. The magnitude of this electric field can thus be adaptively controlled to control the direction of the velocity vector based on the shape of the container's contour and/or any container features BM that happen to be on the container's wall. Examples of such container features BM include bosses and grooves.

The invention has been described heretofore on the basis of exemplary embodiments. It is understood that a large number of modifications or derivations are possible, without thereby departing from the basic inventive concept on which the invention is based.

The invention claimed is:

1. An apparatus comprising a detection segment for use in a device for printing on containers, said device comprising a printing module, said detection segment comprising an image-capturing device, a sensor interface, a computer, a communication interface, said detection segment configured for holding and releasing a retaining-and-centering unit that rotates a container about a vertical axis thereof when said container is retained at said retaining-and-centering unit, wherein said image-capturing device is configured to optically detect a container feature of a container, wherein said sensor interface interfaces with a sensor that uses a code provided on said retaining-and-centering unit to determine a rotational position of said container when said container is retained by said retaining-and-centering unit, wherein said computer connects to said image-capturing device and said sensor unit, wherein said computer is configured for determining an alignment variable based on said code and said detected container feature, and wherein said communication interface is configured to forward said alignment variable to a printer segment on said printer module, wherein said detection segment is a detection module that can be swapped in and out of engagement with a rotor with which a plurality of other identical detection modules are also in engagement.

2. The apparatus of claim 1, wherein said image-capturing device is configured to capture image data concerning a circumference of said container.

3. The apparatus of claim 1, wherein said computer comprises a graphics card, and wherein said computer is configured for parallel processing of image data using graphics card programming.

4. The apparatus of claim 1, further comprising a wire-bound communication channel, wherein said detection segment is configured to transmit said alignment variable to said printing segment using said wire-bound communication channel.

5. An apparatus comprising a detection segment for use in a device for printing on containers, said device comprising a printing module, said detection segment comprising an image-capturing device, a sensor interface, a computer, a communication interface, said detection segment configured for holding and releasing a retaining-and-centering unit that rotates a container about a vertical axis thereof when said container is retained at said retaining-and-centering unit, wherein said image-capturing device is configured to optically detect a container feature of a container, wherein said sensor interface interfaces with a sensor that uses a code provided on said retaining-and-centering unit to determine a rotational position of said container when said container is retained by said retaining-and-centering unit, wherein said computer connects to said image-capturing device and said sensor unit, wherein said computer is configured for determining an alignment variable based on said code and said detected container feature, and wherein said communication interface is configured to forward said alignment variable to a printer segment on said printer module, wherein said computer is configured to determine a difference between an angular coordinate of a reference mark on said container and an angular coordinate of said container feature, wherein said alignment variable is derived from said difference, and wherein said communication interface is configured to forward said alignment variable to said printing module.

6. The apparatus of claim 5, further comprising a rotor, wherein said detection segment is provided on said rotor.

7. The apparatus of claim 5, wherein said image-capturing device is configured to capture image data concerning at most a portion of a circumference of said container, said portion being less than said circumference.

8. The apparatus of claim 5, wherein said detection segment further comprises storage for storing data regarding a container feature that is being sought by said detection segment.

9. The apparatus of claim 5, wherein said computer is configured to compare image data acquired by said image-capturing device with stored data regarding a container feature that is being sought by said detection segment.

10. The apparatus of claim 5, further comprising a wireless communication channel, wherein said detection segment is configured to transmit said alignment variable to said printing segment using said wireless communication channel.

11. The apparatus of claim 5, further comprising a first rotor having printing segments disposed thereon and a second rotor downstream from said first rotor in a container-transport direction, said first rotor comprising plural detection segments disposed on a periphery thereof, one of said detection segments being said detection segment, said first rotor being configured to transfer a retaining-and-centering unit having a container held thereon to said second rotor, which is configured to receive said retaining-and-centering unit from said first rotor.

12. The apparatus of claim 5, further comprising a first rotor on which said detection segment is disposed and a plurality of second rotors, wherein, for each second rotor, no more than one printing segment on said rotor will print upon said container, wherein said alignment variable is received only by said printing segment, whereby, for each of said second rotors, at most one printing segment receives said alignment variable.

13. The apparatus of claim 5, wherein said detection segment is configured to forward said retaining-and-centering unit to said printing segment and to do so with said container having been rotated to a desired angle.

14. The apparatus of claim 5, wherein said communication interface comprises an infrared interface.

15. An apparatus comprising a detection segment for use in a device for printing on containers, said device comprising a printing module, said detection segment comprising an image-capturing device, a sensor interface, a computer, a communication interface, said detection segment configured for holding and releasing a retaining-and-centering unit that rotates a container about a vertical axis thereof when said container is retained at said retaining-and-centering unit, wherein said image-capturing device is configured to optically detect a container feature of a container, wherein said sensor interface interfaces with a sensor that uses a code provided on said retaining-and-centering unit to determine a rotational position of said container when said container is retained by said retaining-and-centering unit, wherein said computer connects to said image-capturing device and said sensor unit, wherein said computer is configured for determining an alignment variable based on said code and said detected container feature, and wherein said communication interface is configured to forward said alignment variable to a printer segment on said printer module, further comprising a plurality of rotors that together define a container transport path on which containers are moved in a transport direction from a container inlet to a counter outlet, each rotor being configured to rotate about a vertical machine-axis thereof, wherein said rotors comprise a first rotor and a second rotor, wherein said detection segment is one of a plurality of identical detection segments disposed on said first rotor, wherein said second rotor follows said first rotor in said transport direction, wherein said second rotor comprises a plurality of printing segments disposed thereon.

16. The apparatus of claim 15, further comprising a direct drive, wherein said container is configured to be rotated by said direct drive in a controlled manner based on said code.

17. The apparatus of claim 15, wherein said computer is configured to execute a block-matching process for comparing image data acquired by image-capturing device with stored data regarding a container feature that is being sought by said detection segment.

18. The apparatus of claim 15, wherein said detection segment is configured to forward said retaining-and-centering unit to said printing segment and to do so with said container having been rotated to a desired angle.

19. The apparatus of claim 15, wherein all but a first one of said detection segments will not be used to print upon said container, wherein said first detection segment is configured to forward said alignment variable for said container specifically to a particular printing segment on said second rotor that will be used to print on said container.

20. The apparatus of claim 15, wherein said communication interface comprises an infrared interface.

21. The apparatus of claim 15, wherein said detection segment is configured to forward said retaining-and-centering unit to said printing segment and to do so with said container having been rotated to a desired angle.

* * * * *